United States Patent [19]

Seiler

[11] Patent Number: 4,563,677

[45] Date of Patent: Jan. 7, 1986

[54] DIGITAL CHARACTER DISPLAY

[75] Inventor: William J. Seiler, Scotts Valley, Calif.

[73] Assignee: Victor Technologies, Inc., Scotts Valley, Calif.

[21] Appl. No.: 435,199

[22] Filed: Oct. 19, 1982

[51] Int. Cl.[4] ..... G09G 1/00

[52] U.S. Cl. ..... 340/750; 340/731; 340/735

[58] Field of Search ..... 340/750, 735, 731

[56] References Cited

U.S. PATENT DOCUMENTS

| | | | |
|---|---|---|---|
| Re. 31,200 | 6/1983 | Sukonick et al. | 340/731 X |
| 3,896,428 | 7/1975 | Williams | 340/731 |
| 3,928,845 | 12/1975 | Clark | 340/750 X |
| 4,016,544 | 4/1977 | Morita et al. | 340/703 X |
| 4,104,624 | 8/1978 | Hamada | 340/750 |
| 4,115,765 | 9/1978 | Hartke | 340/750 |
| 4,158,837 | 6/1979 | Zahorsky | 340/747 X |
| 4,342,990 | 8/1982 | Traster | 340/750 X |
| 4,345,244 | 8/1982 | Greer et al. | 340/735 X |
| 4,408,200 | 10/1983 | Bradley | 340/731 X |
| 4,414,545 | 11/1983 | Sakaurada et al. | 340/735 X |
| 4,439,759 | 3/1984 | Fleming et al. | 340/703 |
| 4,484,187 | 11/1984 | Brown et al. | 340/703 |

*Primary Examiner*—Gerald L. Brigance
*Assistant Examiner*—Vincent P. Kovalick
*Attorney, Agent, or Firm*—Townsend & Townsend

[57] ABSTRACT

A dual mode raster scanned character display system has a text mode of operation in which characters having a first matrix size are displayed on a CRT screen and a high resolution mode of operation in which display information is bit mapped on the CRT screen. Programmable font characters are stored in a memory and are accessed by controller characters generated in response to display requests supplied by an associated information source, such as a computer or a keyboard. Each controller character includes a special screen attribute multi-bit portion which is used to modify the font characters when coupled to a video signal generator unit to display reverse video, provide underline or strike through, specify one of two fixed intensities, suppress the character or provide a software function, such as CURSOR. In text mode, each character block has a fixed size appropriate to alphanumeric character generation, i.e. ten columns by sixteen rows; in high resolution mode of operation, each character block has a size appropriate to high resolution bit mapped graphic display, i.e. sixteen columns by sixteen rows.

Both display and brightness are controlled by 3 bit digital characters supplied from the keyboard, the digital characters being converted from digital-to-analog form and used to control the brightness signal and the contrast signal level. The font characters are programmable from the associated information source, i.e. the computer.

16 Claims, 8 Drawing Figures

DIGITAL CHARACTER DISPLAY

BACKGROUND OF THE INVENTION

This invention relates to raster scan digital character displays.

In many computer system applications, such as word processing, accounting, and scientific applications, the need exists for display of data, both alphanumeric characters and graphics data. In known systems, the data is typically displayed using a raster scan format in which the characters are displayed on the face of a CRT on a line by line basis, with each character being formed from an m by n matrix of pixel elements, where m and n are integers; or the characters or graphic elements are formed using a bit mapped full screen display. The alphanumeric characters and the graphics elements are typically stored in a memory device as multibit digital characters which are read from memory and processed to provide the blanking signals for the CRT active elements. In many applications, the types of characters and graphic elements which can be displayed, i.e. the display data font, is restricted to the dedicated use for which the computer system is designed. In other systems, the font is limited severely by the size of the memory, so that only a relatively limited number of types of characters or graphic elements can be displayed. In still other systems, the resolution of the alphanumeric characters, and thus the quality of the display, represents a compromise between font size and the size of each individual character matrix.

In order to be suitable for a wide variety of potential uses, a computer system CRT display should possess both high resolution and large font size, as well as great flexibility in the choice of font types and special character types. In addition, such systems should also have the capability of displaying the information at a comfortable brightness and contrast level.

SUMMARY OF THE INVENTION

The invention comprises an improved digital character display having both a text mode of operation and a high resolution mode of operation, each of which is completely programmable by the user and which employs unique screen attributes adding greater flexibility to the display characteristics.

A CRT controller receives text information and control information from a microcomputer and a keyboard. In response to the text information, the controller accesses a screen ram in which 16 bit controller words are stored. Each controller word includes an 11 bit font address and five individual attribute bits. The font address portion of the controller word is set into a first latch and used to access a dot and system RAM, hereinafter termed a pixel RAM in which the font words are stored. Each font word is a 16 bit character and contains the actual pixel information used to drive the CRT elements. In the text mode of operation, the six most significant bits are not displayed: however, the most significant bit is used as a control bit for an underline/-strikeover display function. In the high resolution mode of operation, all 16 bits of the font word are used for video control of the CRT elements. The 16 bit font words output from the pixel RAM are temporarily stored in a latch, the output of which is coupled to a shift register which converts the parallel characters to a serial bit stream.

The 5 bit screen attribute portion of each controller word is successively transferred through a series of latches and is combined in a video control unit with the serial bit stream from the shift register in order to modify the display data in accordance with the screen attributes.

The CRT control unit also receives control data in the form of 3 bit brightness signals and 3 bit contrast signals from the associated keyboard which are coupled to the video control unit and used to adjust the brightness and contrast level of the CRT display.

The CRT control unit also receives control data specifying the alternate modes of operation, and generates internal control signals governing the CRT clock cycle. In the text mode of operation, the clock cycle has ten basic states which define the width of each character cell; in the high resolution mode of operation the CRT clock cycle has sixteen basic states defining the width of each bit mapped display matrix.

For a fuller understanding of the nature and advantages of the invention, reference should be had to the ensuing detailed description taken in conjunction with the accompanying drawings.

DESCRIPTION OF THE PREFERRED EMBODIMENT

Figure 1:
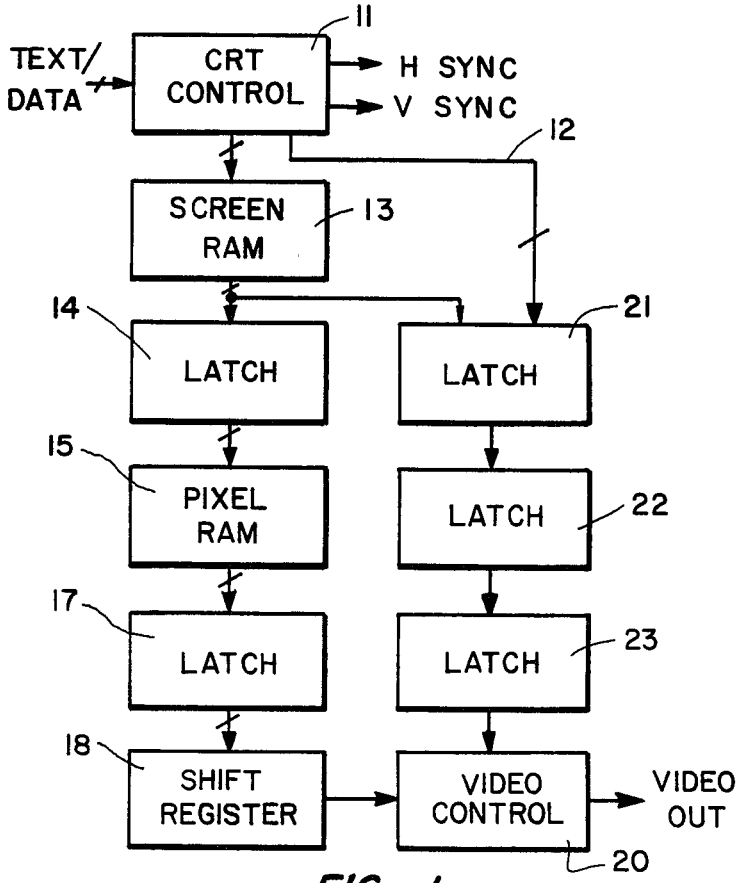
FIG. 1 is a block diagram illustrating the invention.

Turning now to the drawings, FIG. 1 illustrates the basic units of the invention. As seen in this Fig., a CRT control unit 11 receives text and data information from an associated source, such as a microcomputer and a keyboard, and generates internal horizontal and vertical sync timing signals for the associated CRT electronic circuitry. In response to the receipt of text information, the CRT control unit 11 accesses a screen ram 13 in which controller words are stored. A portion of each controller word read from screen ram 13 is placed in a first latch 14 and used to access a pixel RAM 15 in which the individual font words are stored. Each font word output from pixel RAM 15 is placed in a latch 17 and then stored in a shift register 18 which converts the multibit parallel font words into a serial bit stream, which is output to a video control unit 20.

A screen attribute portion of each controller word read from screen RAM 13 is coupled through a series of latches 21–23 to the video control unit 20 in which the serial bit stream output from shift register 18 is modified in accordance with certain screen attributes described below. In addition, CRT control unit 11 provides a pair of additional control signals via separate line 12 to the series of latches 21–23, and to video control unit 20.

Figure 2:
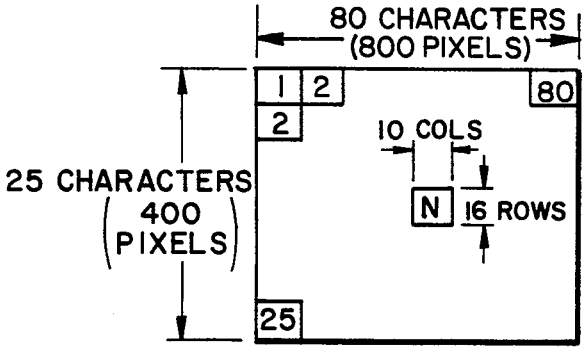
FIG. 2 is a schematic diagram illustrating the text mode of operation.

With reference to FIG. 2, in the text mode of operation, the display screen is arranged as twenty-five rows of individual characters, each row containing eighty columns. Each character is a ten column by sixteen row individual matrix of dots or pixels, so that each character row contains eighty ten by sixteen character matrices, and the full display comprises twenty-five rows of such character matrices.

Figure 3:
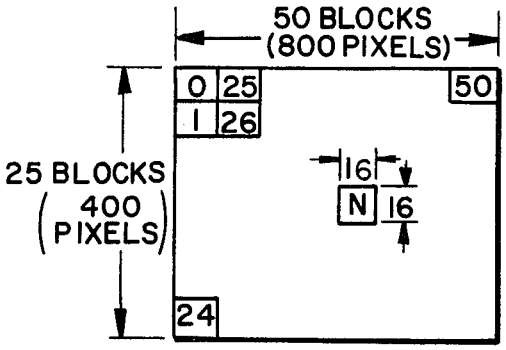
FIG. 3 is a schematic diagram illustrating the high resolution mode of operation.

FIG. 3 illustrates the high resolution mode of operation, which is a bit mapped mode of operation. As seen in this Fig., the display screen is arranged as a series of sixteen by sixteen character blocks, each containing sixteen rows and sixteen columns of pixels, there being fifty blocks in each row and twenty-five rows of such blocks.

Figure 4:
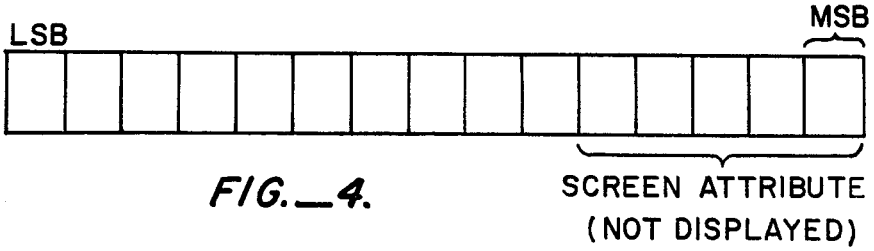
FIG. 4 is a schematic diagram showing a controller word.

FIG. 4 illustrates the format of a controller word of the type stored in screen RAM 13. As seen in this Fig., each controller word is a 16 bit parallel digital character having two portions; a first portion consisting of the first 11 bits, which are used to address the pixel RAM 15, and a second 5 bit portion containing individual screen attribute bits. In the preferred embodiment, there are five attribute bits as follows:

Reverse video-this attribute displays black characters on a white background and affects all the dots in every character.

Display high/low intensity-this attribute displays a character in either a high intensity (enhanced mode) or a low intensity.

Display underline/strikeover-this attribute, which works in conjunction with a font cell control bit described below, creates a solid line all the way through the character cell either in the bottom row as an underscore or as a strikeover in other rows of the character. The strikeover is superimposed over the character when the attribute is turned on and is displayed on the screen.

Nondisplay-this attribute suppresses dot information so that the character is not displayed on the screen.

Software-this attribute is a bit available for software application program use and can be used to identify special fields on the screen, mark the end of lines, or mark special text in an editor.

The screen RAM 13 stores two thousand controller words in random access memory: the lower 11 bits of each word define which of the two thousand forty-eight possible font words stored in pixel RAM 15 are to be placed at that location on the screen. The upper 5 bits specify which of the above noted attributes are to be active in modifying each displayed font word. The five attribute bits are actually sent to the video control unit 20 which adds the reverse video, intensity, underline, nondisplay and software functions, according to the state of each attribute bit.

The lower 11 bits of each controller word comprise the font cell code. The font cell code has other address bits added to it—viz. 5 lower bits and 4 upper bits to generate a font word address. The first 4 of the 5 lower bits specify the raster row and, using this binary code, sixteen raster rows can be addressed which is the number of raster rows in a standard character to be displayed. The lower bit, bit 0, is the byte address bit which is always 0. The upper 4 bits select the sixty-four k block of memory in pixel RAM 15 in which the font words are located. When bit 16 is 0, it selects the lower sixty-four k of memory in pixel RAM 15; if bit cell 16 is one, it selects the next block of sixty-four k of pixel ram 15. The addressed font word is read out from pixel RAM 15 and passed through latch 17 to shift register 18.

In the high resolution mode of operation illustrated in FIG. 3, characters are generated using the high density dot matrix technique which uses a font word as the basic structure within which characters are developed for display. A font cell is a sequential block of sixteen font words which are accessed to form a dot matrix which, as noted above, is 16 bits wide and 16 raster rows high. The least significant bit of the first word is displayed at the 0 position of the font cell display illustrated in FIG. 3. The next line of the font cell is position number 1, etc. The underline/strikeover control bit is the most significant bit of each font word. During high resolution mode of operation, however, this function is disabled.

In either mode of operation, a bit value of 1 displays a white dot, while a bit value of 0 displays a black dot in the normal mode of operation. When the reverse video attribute is active, the characters are reversed. Each font word defines the condition of each dot in the matrix.

Figure 5:
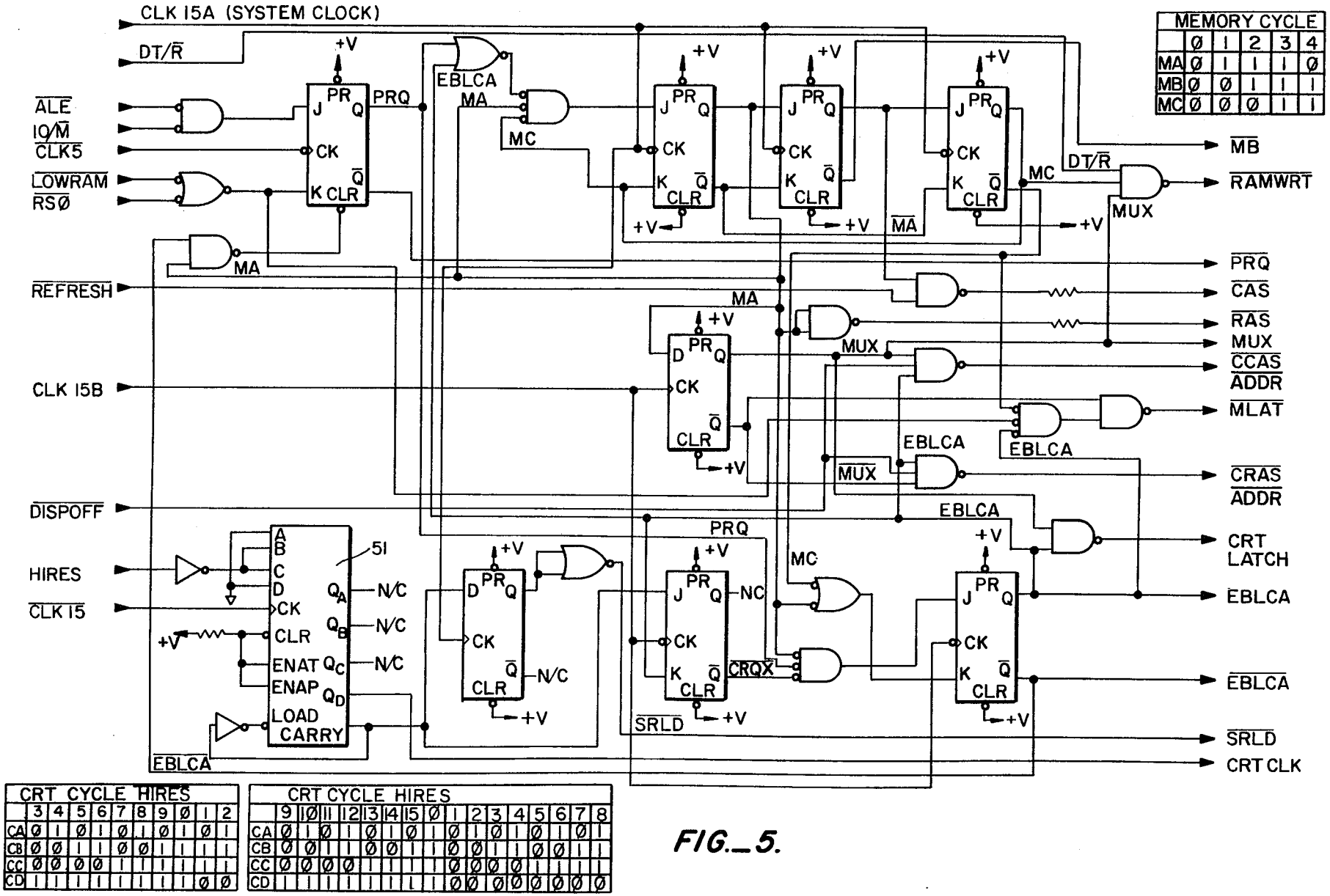
FIGS. 5–8 are logic diagrams illustrating the best mode.

In order to distinguish between the text mode and the high resolution mode of operation, the CRT control unit 11 receives control information specifying which mode is to be followed. In response to the mode signal (supplied on ID lines ID0–ID7), the CRT control unit 11 will control the state of a signal termed HIRES (see FIG. 6). This signal is supplied as a control input to the CRT clock generator 51 (see FIG. 5) to provide the control states illustrated in the two tables directly below the clock generator. The ten step CRT cycle ($\overline{\text{HIRES}}$) is used for the text mode; while the sixteen step CRT cycle (HIRES) is used for the high resolution mode.

Figure 6:
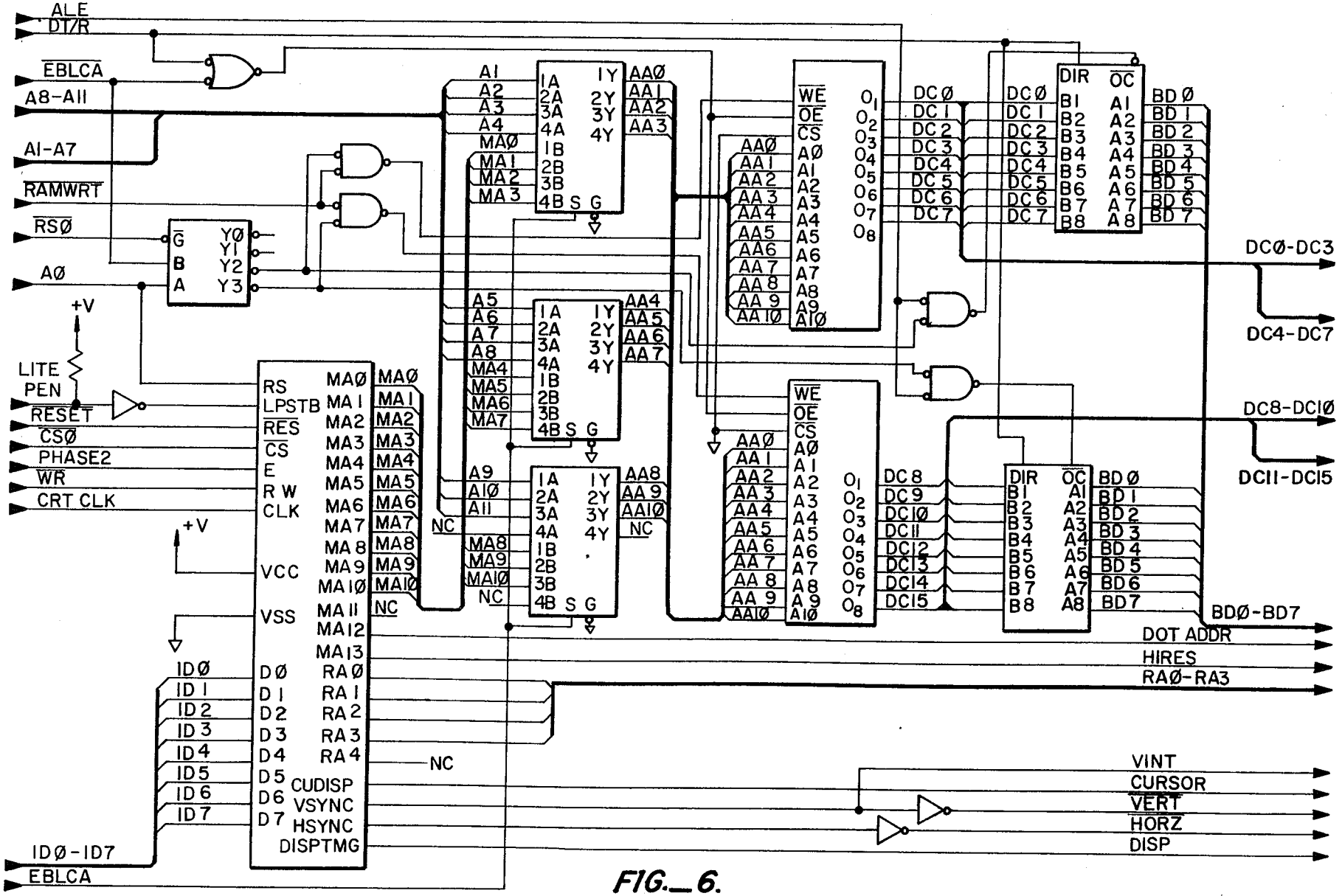
Figure 7:
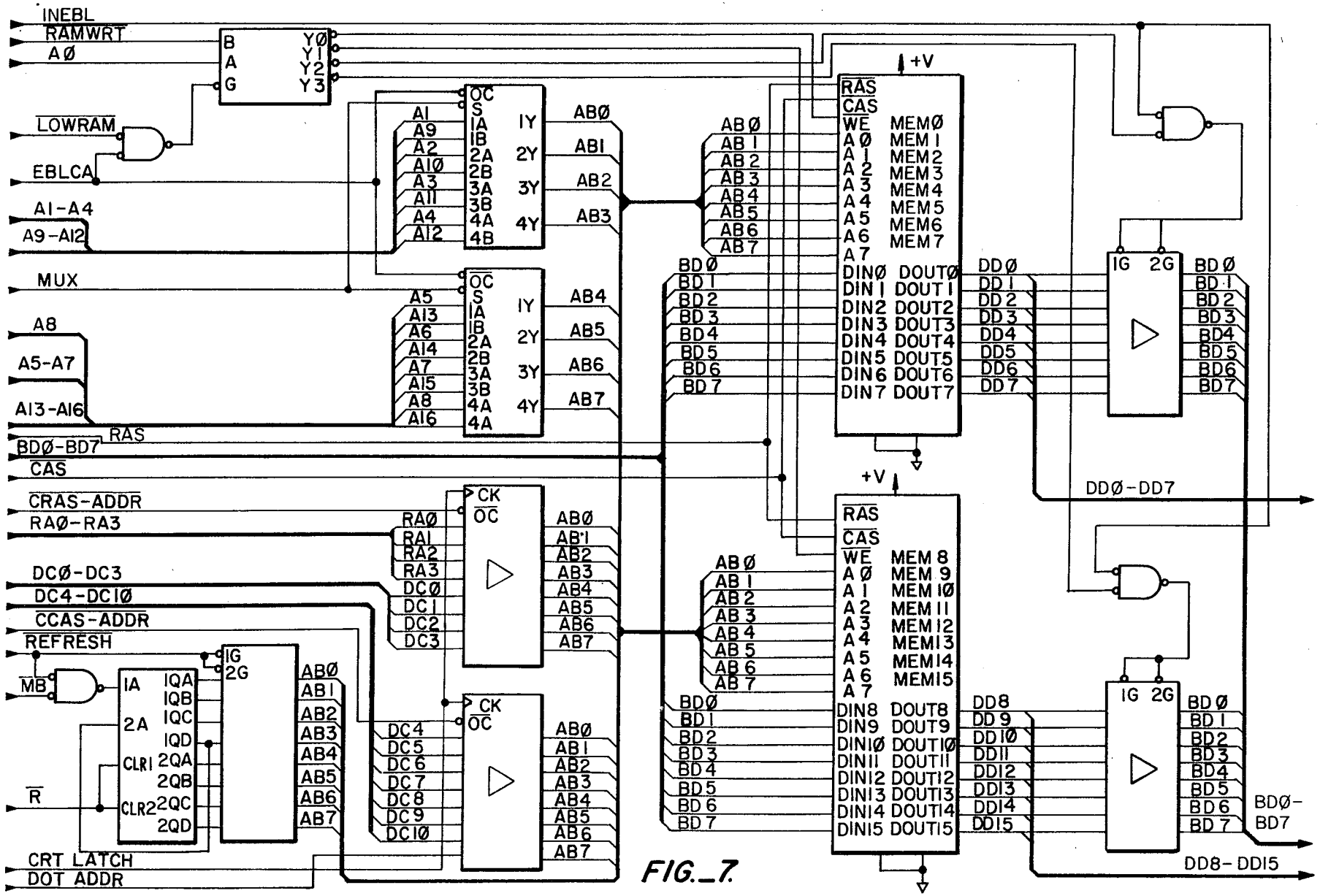
Figure 8:
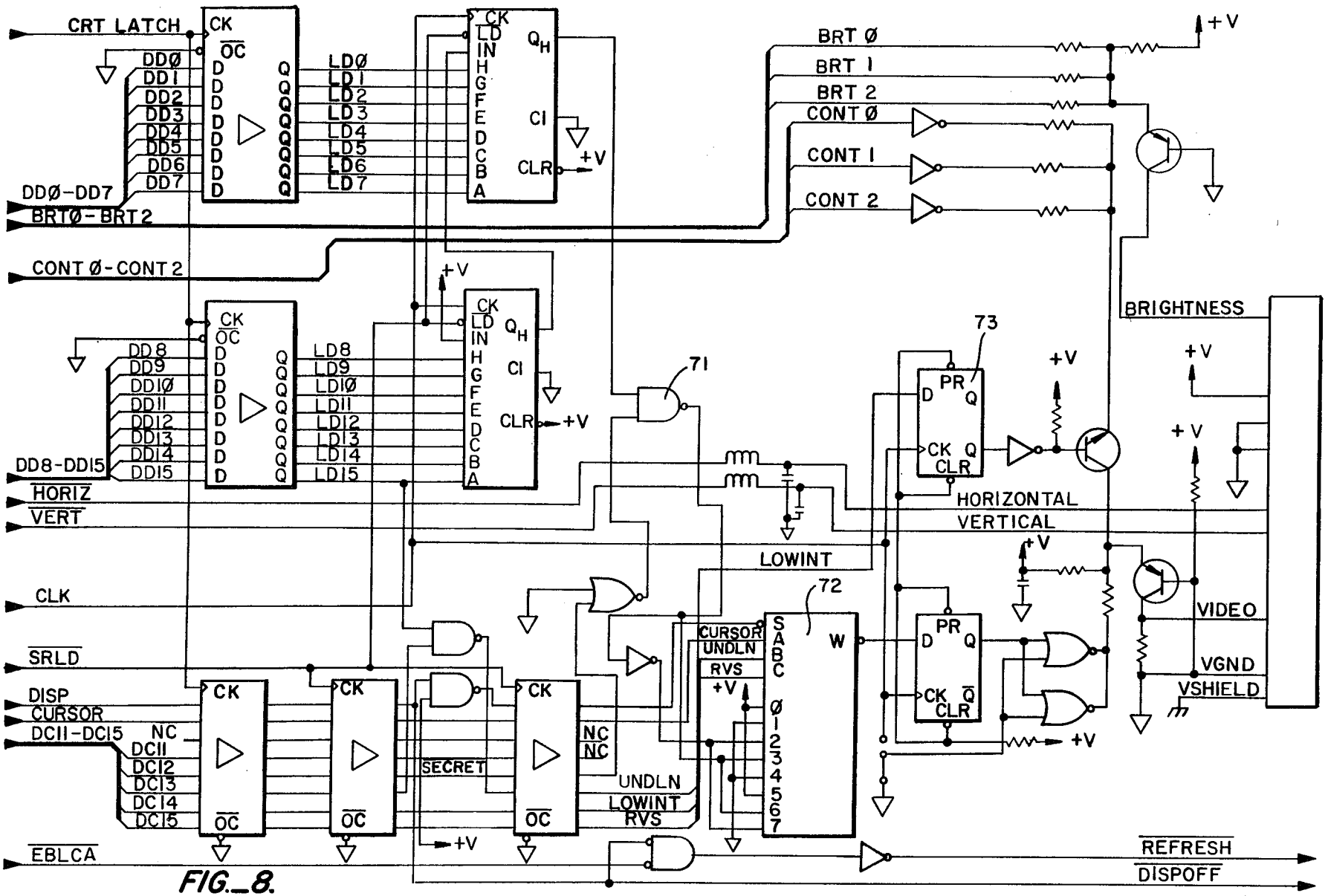

With reference to FIG. 6, the screen ram 13 comprises two 2K×8 6116P-3 static RAM integrated circuits connected as shown and which are addressable through three type LS157 multiplexers either by an address bus A1–A11 or an internal bus from the type 6845S controller, the latter bus being control lines MA0–MA10. The output of the screen RAM 13, viz. the signals on bus lines DC0–DC15 are coupled via a pair of type LS374 latches (FIG. 7) to the pixel RAM which consists of two 64K×8 type 4164 integrated circuits (FIG. 7). The pixel RAM circuits are dynamic memory configured as shown to provide a periodic refresh cycle. The five most significant bits from a screen ram 13, viz. DC11–DC15 are not coupled to the pixel ram 15, but to five inputs of the first type LS374 latch (FIG. 8). The other two inputs to this latch are the DISP and CURSOR control signals supplied directly from the type 6845S controller. The output of the first type LS374 latch is coupled to a second latch, the output of which is coupled to a third latch. The output of the third latch comprises the five possible screen attributes, viz. underline (UNDLN), intensity (LOWINT), reverse (RVS), software (CURSOR) and no display (pin 5 output of the last latch). The no display signal is used to block the inverting AND gate 71 when the character is to be suppressed. The output of gate 71 is coupled through a multiplexer 72 to the D input of a D-type flip-flop, the output of which is used to specify the pixel signal.

Both the level of brightness and level of contrast are controlled by two sets of signals which are supplied from the associated keyboard, the brightness signals being designated BRT0–BRT2, and the contrast signals being designated CONT0–CONT2. Each set of signals is coupled to a separate 3 bit digital-to-analog converter configured as shown in FIG. 8: the brightness DAC controls the current flow through transistor Q 3, the collector output of which is coupled as a brightness signal to the associated CRT electronics. The contrast DAC is used to select the level of current flowing through transistor Q 4 which, in combination with transistor Q 5 supplies the video output signal.

The low intensity attribute is used to set a D-type flip-flop 73, which controls the conduction state of transistor Q 4 to provide two different programmed levels of intensity.

While the above provides a full and complete disclosure of the preferred embodiment of the invention, various modifications, alternate constructions and equivalents may be employed without departing from the true spirit and scope of the invention. Therefore, the above description and illustrations should not be construed as limiting the scope of the invention which is defined by the appended claims.

What is claimed is:

1. A digital character display system for a raster scan display unit, said system comprising:

a control unit for receiving control information characters from an associated source, said control unit including means for generating vertical and horizontal sync timing signals to be coupled to said display;

first memory means having an input coupled to said control unit for storing multi-bit controller characters, each character having a first multi-bit portion specifying font character addresses and a second multi-bit portion specifying character attributes, said first memory means having an output;

second memory means coupled to a first multi-bit portion output of said first memory means and containing a plurality of multi-bit font characters each addressable by a corresponding one of said first multi-bit portions of said multi-bit controller characters;

shift register means having an input coupled to said second memory means for successively storing font characters individually output from said second memory means and for converting said characters from parallel to serial form, said shift register means having an output; and video control means having a first input coupled to the output of said shift register for converting said characters output from said shift register means to video information signals, said video control means having a second input for receiving the character attribute multi-bit portion of each controller character output from said first memory means for modifying said video information signals.

2. A method of displaying text and graphics video information with a character display in a raster scanned format, said method comprising the steps of:

generating a multi-bit digital controller character having a first multi-bit portion specifying an address in a memory of a multi-bit font character to be displayed and a second multi-bit portion specifying at least one screen attribute for the addressed character;

reading the addressed multi-bit font character from said memory with said first multi-bit portion;

supplying the font character read from said memory to a video signal generator in serial bit form; and controlling the operation of said video generator in accordance with said second multi-bit screen attribute portion of said controller character to modify the character display.

3. The invention of claim 1 wherein said system further includes means for synchronizing the arrival of said font characters and said character attribute portions of said controller characters at said video control means.

4. The invention of claim 1 wherein said control until further includes means coupled to said second input of said video control means for generating control signals for said video control means.

5. The invention of claim 1 wherein said first and second memory means have an addressing cycle and said shift register means has a load cycle; and wherein said control unit further includes clock circuit means for controlling the addressing cycle of said first memory means and said second memory means and the load cycle of said shift register means.

6. The invention of claim 5 wherein said clock circuit means includes means responsive to a control information character from the associated source for selecting one of two clock cycles having different periods to enable said display system to selectively operate in a high resolution mode in which all bits of each font character are shifted out of said shift register means and a text mode in which less than all bits of each font character are shifted out of said shift register means.

7. The invention of claim 1 wherein one bit of said second multi-bit portion specifies the character attribute of overall character intensity, and wherein said video control means includes means responsive to the intensity attribute bit for establishing the display intensity of the corresponding font character.

8. The invention of claim 7 wherein said establishing means includes a collector-emitter coupled paired transistor circuit having a pair of transistors, each transistor having a base, and a flip flop having a data input supplied with the intensity attribute bit and an output coupled to the base of one of the transistors in said paired transistor circuit.

9. The invention of claim 2 wherein said method includes the step of temporarily storing said multi-bit screen attribute portion of said controller character until said font character has been serially supplied to the video signal generator.

10. The invention of claim 2 wherein one of said at least one screen attributes is overall character intensity, and wherein said step of controlling includes the steps of establishing the display intensity of said font character in accordance with the intensity attribute bit of said second multi-bit screen attribute portion of said controller character.

11. A method of displaying text and graphics video information in a raster scanned format, said method comprising the steps of:

generating a multi-bit digital controller character having a first multi-bit portion specifying an address in a memory of a multi-bit font character to be displayed and a second multi-bit portion specifying at least one screen attribute for the addressed character;

reading the addressed multi-bit font character from said memory with said first multi-bit portion;

supplying the font character read from said memory to a video signal generator in serial bit form, said step of supplying including the steps of serially supplying all of the bits of said multi-bit font character to said video generator when a high resolution display mode is to be performed and serially supplying less than all of the bits of said multi-bit font character to said video generator when a text display mode is to be performed; and controlling the operation of said video generator in accordance with said second multi-bit screen attribute portion of said controller character to modify the character display.

12. The invention of claim 11 wherein said step of repeating includes the steps of selecting a first rate when displaying text information and selecting a second rate when displaying graphics information.

13. The invention of claim 12 wherein said first rate is higher than said second rate.

14. A method of displaying text and graphics video information in a raster scanned format, said method comprising the steps of:

generating a multi-bit digital controller character having a first multi-bit portion specifying an address in a memory of a multi-bit font character to be displayed and a second multi-bit portion specifying at least one screen attribute for the addressed character;

reading the addressed multi-bit font character from said memory with said first multi-bit portion;

supplying the font character read from said memory to a video signal generator in serial bit form;

controlling the operation of said video generator in accordance with said second multi-bit screen attribute portion of said controller character to modify the character display; and repeating said steps of generating, reading, supplying and controlling at a preselected rate.

15. The invention of claim 14 wherein said delaying means comprises a plurality of serially coupled latch means.

16. A digital character display system for a raster scanned unit, said system comprising:

a control unit for receiving control information characters from an associated source, said control unit including means for generating vertical and horizontal sync timing signals to be coupled to said display;

first memory means having an input coupled to said control unit for storing multi-bit controller characters, each character having a first multi-bit portion specifying font character addresses and a second multi-bit portion specifying character attributes, said first memory means having an output;

second memory means coupled to a first multi-bit portion output of said first memory means and containing a plurality of multi-bit font characters each addressable by a corresponding one of said first multi-bit portions of said multi-bit controller characters;

shift register means having an input coupled to said second memory means for successively storing font characters individually output from said second memory means and for converting said characters from parallel to serial form, said shift register means having an output;

video control means having a first input coupled to the output of said shift register for converting said characters output from said shift register means to video information signals, said video control means having a second input for receiving the character attribute multi-bit portion of each controller character output from said first memory means for modifying said video information signals; and means for synchronizing the arrival of said font characters and said character attribute portions of said controller characters at said video control means, said synchronizing means including a first latch means coupled between said first memory means and said second memory means, a second latch means coupled between said second memory means and said shift register means, said first and second latch means providing temporary intermediate storage of said multi-bit portion of said controller characters and said font characters, respectively, and means coupled between said first memory means and said video control means for delaying said second multi-bit portion of said controller characters in order to synchronize the first and second portions for proper input to the video control means.

* * * * *